US005877143A

United States Patent [19]

Abbas et al.

[11] Patent Number: 5,877,143

[45] Date of Patent: Mar. 2, 1999

[54] COMPOSITION CONTAINING A LAMELLAR LIQUID CRYSTALLINE PHASE WHICH COMPRISES BETAINES AND AMINE OXIDES

[75] Inventors: Syed Husain Abbas, Belle Mead, N.J.; Orum D. Stringer, Yardley, Pa.; Ravi Subramanyam, Belle Mead, N.J.

[73] Assignee: Colgate-Palmolive Co., New York, N.Y.

[21] Appl. No.: 975,591

[22] Filed: Nov. 20, 1997

[51] Int. Cl.[6] ..... C11D 1/75; C11D 1/90; C11D 1/92; C11D 7/10

[52] U.S. Cl. ..... 510/433; 510/119; 510/123; 510/124; 510/130; 510/135; 510/235; 510/237; 510/317; 510/333; 510/356; 510/409; 510/433; 510/424; 510/503; 510/508

[58] Field of Search ..... 510/119, 123, 510/124, 130, 135, 235, 237, 317, 333, 356, 409, 433, 503, 508, 424

[56] References Cited

U.S. PATENT DOCUMENTS

| | | | |
|---|---|---|---|
| 3,842,847 | 10/1974 | Hewitt et al. | 132/7 |
| 4,166,845 | 9/1979 | Hansen et al. | 424/78 |
| 4,243,549 | 1/1981 | Messenger et al. | 252/355 |
| 4,299,739 | 11/1981 | Esposito et al. | 252/545 |
| 4,329,335 | 5/1982 | Su et al. | 424/70 |
| 4,832,871 | 5/1989 | Bade | 252/546 |
| 4,891,150 | 1/1990 | Gross et al. | 252/142 |
| 5,021,195 | 6/1991 | Machin et al. | 252/545 |
| 5,039,451 | 8/1991 | Phillips et al. | 252/356 |
| 5,346,641 | 9/1994 | Argo et al. | 252/163 |
| 5,354,906 | 10/1994 | Weitemeyer et al. | 554/52 |
| 5,417,893 | 5/1995 | Ofosu-Asante | 252/558 |
| 5,464,565 | 11/1995 | Hamann et al. | 252/546 |
| 5,466,870 | 11/1995 | Miller et al. | 564/298 |
| 5,637,758 | 6/1997 | Sajic et al. | 560/147 |
| 5,698,505 | 12/1997 | Ofosu-Asante | 510/221 |
| 5,700,773 | 12/1997 | Jakubicki et al. | 510/426 |

*Primary Examiner*—Mark Kopec
*Assistant Examiner*—Charles Boyer
*Attorney, Agent, or Firm*—Martin B. Barancik

[57] ABSTRACT

A pumpable, fluid composition of amine oxide, betaine and/or sultaine is prepared with active concentration of about 36–45% of these materials by the addition of alkaline earth or aluminum salts.

10 Claims, No Drawings

COMPOSITION CONTAINING A LAMELLAR LIQUID CRYSTALLINE PHASE WHICH COMPRISES BETAINES AND AMINE OXIDES

BACKGROUND OF THE INVENTION

Betaines, sultaines, and amine oxides have been used in consumer products for many years. These high performance amphoteric or amphoteric-type compounds can be used alone or in combination with commonly used anionic surfactants to provide products with enhanced properties: reduced skin and eye irritation, reduced dryness, smoother skin feel, better hair conditioning, and the like. Their use in formulations enhance viscosity building, foam development, and cleansing performance. Generally, these materials, particularly the betaine and amine oxide surfactants, are available commerically as aqueous solutions in 30% concentrations of active ingredients (AI), by weight. In general, the maximum concentrations of surfactant obtainable in the finished raw materials are determined by the rheological properties of the surfactant systems. Below about 30% concentration, the surfactant systems are free flowing isotropic solutions. Above this concentration, liquid crystalline phases are formed which have undesirable Theological properties. Some of the phases have very high viscosity. Manipulation of the surfactants with these phases is very difficult. The handling of this type of system is, therefore, quite inconvenient. For this reason, surfactant compositions with higher concentrations are not commercially available at this time. Among the benefits of higher active concentration materials are: reduced cost of shipping; less storage space; purer, more uniform product; availability of super concentrated finished products; and a greater resistance to microbial degradation.

Therefore, there have been efforts directed to preparation of higher percent AI materials. Hamann, et al, U.S. Pat. No. 5,464,565 utilized the addition of lower alkyl molecular weight tertiary amino acids (betaine or betaine like) e.g., trimethylglycine, to the reaction mixture in the preparation of betaine surfactant from its corresponding amine base and the monochlorosodium acetate reactant. Additionally, Weitemeyer et al, U.S. Pat. No. 5,354,906, retained small amounts, approximately 1 to 3 wt %, of fatty acid in the final betaine mixture. These methods are only nominally effective. While they increased total solids to about 45 to 50 wt %, they raise the active ingredient level percent of Al to only 40 wt % while introducing unwanted extra impurities into any finished formulation. In an attempt to overcome the limitations of aqueous systems, Bade, et al, U.S. Pat. No. 4,832,781, describes preparing betaine in isopropyl alcohol and other lower molecular weight polar organic solvents followed by azeotropic distillation of water. While preparing concentrations up to about 70 wt. % AI, the removal of the solvent before or after concentration remains an undesirable necessity. All of these attempts were made to obtain a high concentration of surfactants in isotropic solution form. Sometimes the transformation of phases from intractable systems to ones having desirable Theological properties can be achieved by utilizing additives such as fatty alcohols, fatty acids, fatty esters, or blending with other surfactants and organic solvents. Messenger et al, U.S. Pat. No. 4,243,549 was able to obtain lamellar liquid crystalline phase with 60 to 70 wt % surfactant concentration by blending alkyl betaines with anionic surfactants.

Therefore, there still exists significant motivation for a workable, pourable, pumpable solution of amphoterics such as betaines and/or sultaines together with an amine oxide of a relatively high weight percent AI concentration.

SUMMARY OF THE INVENTION

In accordance with the invention there is a fluid, pumpable aqueous composition comprising:

a) 1. at least one compound of the formula:

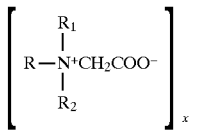

2. at least one compound of the formula:

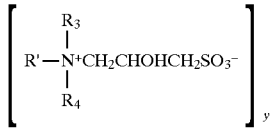

3. at least one compound of the formula:

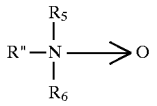

wherein R, R' and R" are the same or at least one of them is different and are selected from the group consisting of alkyl or alkenyl of about eight to about twenty carbon atoms, inclusive, alkyl or alkenylamido alkylene wherein alkyl or alkenyl is about 8 to about 20 carbon atoms and alkylene is two or three carbon atoms;

$R_1$, $R_2$, $R_3$, $R_4$, $R_5$, and $R_6$ are the same or at least one of them is different and are alkyl of one to three carbon atoms, inclusive, X and Y are 0 or 1 with the proviso that X and Y can not both be 0 at the same time, with the overall proviso that component a is from about 36 to about 45 wt % of the composition;

b) an amount of a salt selected from the group consisting of alkaline earth salts, aluminum salts, or mixtures thereof, sufficient to provide a fluid, pumpable composition, and c) the balance water.

A further aspect of the invention is a process which comprises reacting a(1) at least one amine of the formula

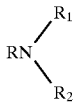

wherein R is selected from the group consisting of alkyl or alkenyl of about eight to about twenty carbon atoms, inclusive, or alkyl or alkenylamido alkylene wherein alkyl or akenyl is about eight to twenty carbon atoms, inclusive, alkylene is two or three carbon atoms, $R_1$ and $R_2$ are the same or different and are alkyl of one to three carbon atoms, inclusive with a(2) at least one salt comprising (a) a cation which is an alkali metal, an alkaline earth metal or mixtures thereof, and (b) an anion which is an alpha halo acetate, a 3-halo-2-hydroxy-1-propane sulfonate, or mixtures thereof wherein the said salt is at less than stoichiometric quantities of the total amine in a(1) thereby forming a reaction product; and b(1) reacting unreacted amine of the formula

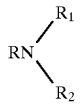

wherein R, $R_1$, and $R_2$ are identified in a(1) with b(2) hydrogen peroxide to form the amine oxide with the proviso that the organic reaction product is from about 36 to about 45 wt. % of the composition and that an aluminum salt or additional alkaline earth salt is added to the reaction when an alkaline earth metal is used in a(2) and an aluminum salt or alkaline earth salt is added to the reaction when an alkali metal is used in a(2).

DETAILED DESCRIPTION OF THE INVENTION

The commercial synthesis of betaines, particularly, cocoamidopropylbetaine (CAPBE) is well known. The manufacture is generally carried out in two steps. In the first step, a lauric oil, such as coconut or palm kernel, a triglyceride, fatty acid, or its methyl ester is reacted with dimethylaminopropylamine (DMAPA) to form the intermediate cocoamidopropyldimethylamine (CAPA). In the second step, CAPA is reacted with a stoichiometric amount of the sodium salt of monochloroacetic acid (SMCA) to form CAPBE and sodium chloride. The second step is carried out in the presence of water, and generally the finished product contains 30–35% CAPBE, 3% glycerine, and 5–6% sodium chloride. In order to improve the color, the product mixture is treated with hydrogen peroxide (1–2%). The second step is quite pH sensitive. In the presence of water and with extended reaction times, two competing reactions take place. SMCA hydrolyzes to produce glycolic acid which liberates HCl. The HCl combines with the CAPA, hindering its reaction with SMCA which further prolongs the reaction time. Only stoichiometric amounts of CAPA and SMCA are generally used, and with the consumption of the two reactants in side reactions, the overall yield of CAPBE is decreased. After bleaching the product, the excess peroxide must be destroyed before use in personal care products.

The manufacture of sultaines, for example, cocoamidopropylsultaine (CAPSU), or amine oxide, for example, cocoamidopropyldimethylamine oxide (CAPAO) begins with the synthesis of CAPA, as shown above. CAPA is reacted in a second step with 3-chloro-2-hydroxy-1-propane sulfonate (CHPS) to produce CAPSU, generally at a 40–44% concentration of active in water. CAPA is also oxidized with hydrogen peroxide to give CAPAO as a 30–35% solution in water.

The maximum concentrations of surfactant obtainable in the finished raw materials are determined by the rheological properties of the surfactant systems. Below about 30% concentration, the surfactant systems are free-flowing isotropic solutions. Above this concentration, liquid crystalline phases are formed which have undesirable Theological properties. Some of the phases have very high viscosity and manipulation of the surfactants with these phases is very difficult. The handling of this type of system is very inconvenient. For this reason, surfactant compositions with higher concentrations are commercially not available.

The reaction of this invention can be carried out in one reactor. By having a higher active ingredient level within the reactor, hydrolysis of the betaine producing reactant, alpha halo acetate, is reduced thereby increasing the yield of betaine. The use of the oxidizing agent hydrogen peroxide not only produces the amine oxide but also improves reaction product color.

With respect to the alkyl or alkenyl group of the starting amine, R, R' and R", the alkyl or alkenyl is about 8 to about 20 carbon atoms, inclusive, preferably about 10 to about 18 carbon atoms, inclusive. The alkyl or alkenyl can be branched or preferably up to about 20% of the alkyl or alkenyl groups are branched. More preferably, the alkyl or alkenyl groups are normal or only a limited number less than about 10% are branched. Alkyl is preferred over alkenyl.

The alkylene grouping in the alkyl or alkenylamidoalkylene is preferably three carbon atoms in length.

The alkyl groupings $R_1$, $R_2$, $R_3$, $R_4$, $R_5$ and $R_6$ are preferably the same and are preferably methyl.

The halo substituted reactant used to prepare the betaine or sultaine-like product is generally any halo (F, Cl, Br, I) but is preferred to be chloro or bromo and more preferably chloro.

The salt form of the halo substituted reactant used in prior commercial synthesis of the betaine or sultaine is usually the sodium salt. It has been found that the sodium salt can still be used in the synthesis but that the presence of an alkaline earth metal salt or preferably an aluminum salt, is very helpful in maintaining the flowability of the reaction product mass at the active ingredient wt % of about 36 to about 45, preferably about 37 to about 43 wt %. Alkaline earth metal includes calcium and magnesium. They are both preferred. The salt anion can be halide, nitrate, sulfate, and the like. The halides, are preferred, more preferably chloride and bromide, most preferably chloride. When using the aluminum salt, the same preferences are used. Because of the physical nature of the aluminum salts, it is preferred to use the hydrated form, for example, the hexahydrate of aluminum chloride is a preferred form of aluminum salt. The presence of the alkaline earth salt can be as an additional additive during the reaction of the amine with the sodium salt of the alpha haloacetate or the 3-halo-2-hydroxypropyl sulfonate or the cation can actually be used as the cation of the alpha halo acetate or the 3-halo-2-hydroxypropyl sulfonate, e.g., $ClCH_2COO^-\frac{1}{2}Mg^{++}$ or $ClCH_2CH_2OHCH_2SO_3$-½Ca++. However, when this occurs, additional alkaline earth salt or preferably an aluminum salt is added to the reactor. The quantity of salt present in the reactor above that obtained by the stoichiometry of the reacting species is from about 0.5 to about 12 wt. % of the composition, preferably about 1 to about 11 wt. %.

When present during the course of the reaction either the aluminum salt or the alkaline earth salt can make the reactant composition more readily fluid and processable. The alkaline earth or aluminum salt can also be added to the composition after the reaction has taken place if it can be readily dispersed in the reactor contents.

The temperature of the reaction of the amine with the alpha halo acetate, 3-halo-2-hydroxypropyl sulfonate and the hydrogen peroxide is not unduly significant. The primary parameters are the length of reaction and the control thereof, particularly with respect to the oxidation of the amine with the oxidizing agent. Generally, from about 5° C. to about 100° C. is effective, preferably about 85° to 99° C. for betaine and sultaine formations. Higher temperature can be employed particularly in a closed system since the betaine and sultaines are generally quite temperature stable. With respect to the formation of the amine oxide, a lower maximum temperature should generally be observed since amine oxides are subject to transformations at certain higher temperatures, for example Meisenheimer and Cope rearrangements. Therefore, lower temperatures can be employed with facility, for example 5° C. and above. Higher temperatures above about 95° C. should generally be avoided.

The amine oxide can be made initially or prepared after the betaine and/or sultaine are prepared. However, it has been found that the former leads to longer reaction times and it is preferred to oxidize non-reacted amine after the sultaine and/or betaine have been prepared. The amine can initially be reacted with the halo containing salts on a stoichiometric basis and then additional amine added to react with the oxidizing agent. Alternatively, one can start with an excess of amine in comparison to the halo salt, prepare the betaine and/or sultaine and then react the remaining amine with the added oxidizing agent.

The usage of the alkaline earth or the aluminum salts change the rheology of the system substantially. What can range from a highly viscous solution to an almost rigid gel, non-responsive to either stirring apparatus or pumping action, can now become at least essentially fluid, even at low temperatures approaching 4° C. The composition is significantly less viscous, and often at times homogeneous when the alkaline earth or preferably the aluminum salts are present. At the specified active ingredient weight percents, that is the betaine and/or sultaine and the amine oxide, earlier disclosed, the presence of these salts, particularly, the aluminum salt, appear to bring about a different rheology. This difference seems to manifest itself as a change from cubic and hexagonal crystals or liquid crystalline phases which are quite viscous and/or rigid to a lamellar liquid crystalline phase which is quite readily processable because of the fact that the bilayer sheets are able to easily slip past one another, particularly while under shear.

Below is a general procedure used to prepare the examples of the invention, as well as the comparative examples. The examples of the invention are intended to illustrate the broad inventive nature of the invention and not limit that broad concept.

Synthesis of Betaine/Amine Oxide Mixtures Containing Salts

General Procedure

Water, an alpha chloroacetate salt, CAPA, and an [optional] additional salt are combined and heated at 88°–90° C. The mixture is stirred mechanically at about 20–40 rpm. The mixture forms a thick gel. As the reaction proceeds, it gradually thins with the buildup of mechanically induced foam. After 2 hours, the mixture is cooled to 60° C. and an aliquot of concentrated HCl is added (60% of total addition). After 5 to 10 minutes, the hydrogen peroxide is added in 4 separate aliquots at 20 minute intervals. The stirring rate is increased to about 120–140 rpm. After the third addition, the remaining 40% portion of HCl is added to the mixture, followed after 5 minutes by the final hydrogen peroxide aliquot. The mixture is then stirred at 65°–70° C. until TLC (silica gel GF/80 chloroform:23 methanol:3 conc. aq. ammonia) indicates absence of CAPA (2–3 hours). The hot foamy material is then transferred to a storage vessel and allowed to settle. After the foam collapses (24–36 hours), the product is observed under an optical microscope to assess the phases formed in the system. The CAPA utilized is obtained commercially and has up to 9 wt. % glycerine. The glycerine does not appear to affect the process significantly and can be a favorable constituent in consumer care products.

EXAMPLE 1

40% AI Betaine/Amine Oxide (30/10) and Magnesium Chloride Using Commercial Glycerine Containing (91%) CAPA

| Ingredients | Weight (g) |
|---|---|
| CAPA (91%) | 37.85 |
| *Monochloroacetic Acid (98%) | 8.18 |
| Hydrogen Peroxide (30%) | 3.7 |
| HCl (Conc. aq., d. 1.19) | 2.98 |
| *Magnesium Oxide | 1.73 |
| Magnesium Chloride Hexahydrate | 1.3 |
| Deionized Water | 44.26 |

*Present in stoichiometric quantities to produce a magnesium salt

The experiment is run as described by the general procedure. The reagent proportions are chosen to provide product concentration of 30% betaine and 10% amine oxide for a total of 40% AI plus 10% magnesium chloride hydrate, but no sodium chloride. The product obtained is a two phase mixture of isotropic solution with suspended hexagonal liquid crystalline phase. After appropriate shearing action, the resultant homogeneous mixture is both pourable and pumpable. Upon standing, phases separate, thereby requiring further shearing to restore the homogeneity.

COMPARATIVE EXAMPLE 1

40% AI Betaine/Amine Oxide (30/10) Using Commercial Glycerine Containing (91%) CAPA

| Ingredients | Weight (g) |
|---|---|
| CAPA(91%) | 37.85 |
| Sodium Monochloroacetate (99%) | 10.65 |
| Hydrogen Peroxide (30%) | 3.7 |
| HCl (Conc. aq., d. 1.19) | 2.98 |
| Deionized Water | 44.8 |

The experiment is run as described by the general procedure. The reagent proportions are chosen to provide product concentration of 30% betaine and 10% amine oxide for a total of 40% AI. The final product is in the form of a two phase mixture of isotropic solution with a suspended hexagonal liquid crystalline phase. This reaction product mixture is sufficiently viscous as to be non-pourable. Application of normal shear to this composition does not produce a fluid pumpable composition.

EXAMPLE 2

40% AI Betaine/Amine Oxide (30/10) and Aluminum Chloride Using Commercial Glycerine Containing CAPA

| Ingredients | Weight (g) |
|---|---|
| CAPA (91%) | 378.5 |
| Sodium Monochloroacetate (99%) | 106.5 |

-continued

| Ingredients | Weight (g) |
|---|---|
| Hydrogen Peroxide (30%) | 37.0 |
| HCl (Conc. aq., d. 1.19) | 29.8 |
| Aluminum Chloride Hexahydrate | 20.0 |
| Deionized Water | 428.2 |

The experiment is run as described by the general procedure. The reagent proportions are chosen to provide product concentrations of 30% betaine and 10% amine oxide for a total of 40% AI plus 2% aluminum chloride hexahydrate and 2.4% glycerine. The product obtained is a translucent free flowing fluid composition.

COMPARATIVE EXAMPLE 2

40% AI Betaine/Amine Oxide (30/10) and Magnesium Chloride Using Commercial Glycerine Containing (91%) CAPA

| Ingredients | Weight (g) |
|---|---|
| CAPA (91%) | 37.85 |
| *Monochloroacetic Acid (98%) | 8.18 |
| Hydrogen Peroxide (30%) | 3.7 |
| HCl (Conc. aq., d. 1.19) | 2.98 |
| *Magnesium Oxide | 1.73 |
| Deionized Water | 45.56 |

*Present in stoichiometric quantities to produce a magnesium salt

The experiment is run as described by the general procedure. The reagent proportions are chosen to provide product concentrations of 30% betaine and 10% amine oxide for a total of 40% AI containing 4% magnesium chloride with no sodium chloride. The product obtained is a homogeneous, rigid liquid crystalline phase which is neither pourable nor pumpable, even after application of normal shear. These results show the significance of additional alkaline earth salts beyond those produced by neutralization of the betaine or sultaine precursor material in order to produce a fluid, pumpable composition.

EXAMPLE 3

42% AI Betaine/Amine Oxide (30/12) and Aluminum Chloride Using Commercial Glycerine-Free CAPA

| Ingredients | Weight (g) |
|---|---|
| CAPA (97%) | 371.5 |
| Sodium Monochloroacetate (99%) | 106.5 |
| Hydrogen Peroxide (30%) | 44.2 |
| HCl (Conc. aq., d. 1.19) | 29.8 |
| Aluminum Chloride Hexahydrate (99%) | 20.0 |
| Deionized Water | 428.0 |

The experiment is run as described by the general procedure. The reagent proportions are chosen to provide product concentrations of 30% betaine and 12% amine oxide for a total of 42% AI plus 2% aluminum chloride hexahydrate. The product obtained is a translucent free flowing fluid composition.

COMPARATIVE EXAMPLE 3

45% AI Betaine/Amine Oxide (33/12) and Calcium Chloride Using Commercial Glycerine Containing (91%) CAPA

| Ingredients | Weight (g) |
|---|---|
| CAPA (91%) | 37.85 |
| Sodium Monochloroacetate (99%) | 11.32 |
| Hydrogen Peroxide (30%) | 4.05 |
| HCl (Conc. aq., d. 1.19) | 2.98 |
| Calcium Chloride Dihydrate | 1.00 |
| Deionized Water | 39.06 |

The experiment is run as described by the general procedure. The reagent proportions are chosen to provide product concentrations of 33% betaine and 12% amine oxide for a total of 45% AI plus 1% calcium chloride dihydrate. The product obtained is a very rigid liquid crystalline phase which is neither pourable nor pumpable, even after application of normal shear.

What is claimed is:

1. A fluid pumpable aqueous composition which contains a lamellar liquid crystalline phase and further comprises a) 1. at least one compound of the formula:

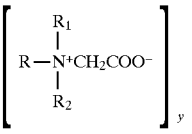

2. at least one compound of the formula:

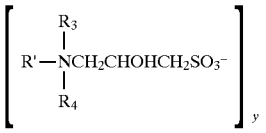

3. at least one compound of the formula:

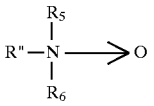

wherein R, R' and R" are the same or at least one of them is different and are selected from the group consisting of alkyl or alkenyl of about eight to about twenty carbon atoms, inclusive, alkyl or alkenylamido alkyene wherein alkyl or alkenyl is about 8 to about 20 carbon atoms and alkylene is two or three carbon atoms;

$R_1$, $R_2$, $R_3$, $R_4$, $R_5$, and $R_6$ are the same or at least one of them is different and are alkyl of one to three carbon atoms, inclusive, x and y are 0 or 1 with the proviso that x and y can not both be 0 at the same time, with the overall proviso that component a is from about 36 to about 45 wt. % of the composition;

b) From about 0.5% to about 12% by weight of a salt selected from the group consisting of alkaline earth salts, aluminum salts, or mixtures thereof sufficient c) the balance is water.

2. The claim in accordance with claim 1 wherein alkylene is three carbon atoms and $R_1$, $R_2$, $R_3$, $R_4$, $R_5$, and $R_6$ are the same and are methyl.

3. The composition in accordance with claim 2 wherein R, R' and R" are the same.

4. The composition in accordance with claim 2 wherein component b is an alkaline earth salt.

5. The composition in accordance with claim 2 wherein component b is an aluminum salt.

6. The composition in accordance with claim 5 wherein the salt is from about 1 to about 11 wt. % of the composition.

7. The composition in accordance with claim 2 wherein component a is from about 37 to about 43 wt. % of the composition.

8. The composition in accordance with claim 7 wherein the salt is chloride.

9. The composition in accordance with claim 8 wherein the salt is an aluminum chloride.

10. The composition in accordance with claim 9 wherein the salt is aluminum chloride hexahydrate.

* * * * *